US006929470B1

(12) United States Patent
Lifshits et al.

(10) Patent No.: US 6,929,470 B1
(45) Date of Patent: Aug. 16, 2005

(54) LOW NOX DUCT BURNER

(75) Inventors: Vladimir Lifshits, Redwood City, CA (US); Kenneth Y. Ahn, South San Francisco, CA (US)

(73) Assignee: Coen Company, Inc., Burlingame, CA (US)

( * ) Notice: Subject to any disclaimer, the term of this patent is extended or adjusted under 35 U.S.C. 154(b) by 0 days.

(21) Appl. No.: 10/688,792

(22) Filed: Oct. 16, 2003

Related U.S. Application Data

(60) Provisional application No. 60/422,624, filed on Oct. 30, 2002.

(51) Int. Cl.[7] ..... F23D 14/46
(52) U.S. Cl. ..... 431/350; 431/354; 432/222
(58) Field of Search ..... 431/350, 354, 431/351, 352, 202, 171, 175, 174, 8, 9, 10, 431/207, 215, 11; 432/222, 187, 194, 196, 432/145; 60/39.5, 749

(56) References Cited

U.S. PATENT DOCUMENTS 3,649,211 A * 3/1972 Vosper ..... 431/350
3,732,059 A * 5/1973 Goodnight et al. ..... 431/286
4,462,795 A * 7/1984 Vosper et al. ..... 431/350
4,737,100 A * 4/1988 Schnell et al. ..... 432/222
4,767,319 A * 8/1988 Vosper ..... 431/350
4,895,514 A * 1/1990 Cantryn et al. ..... 431/350
6,301,875 B1 * 10/2001 Backlund et al. ..... 431/9
6,409,502 B2 * 6/2002 Bury ..... 431/350

FOREIGN PATENT DOCUMENTS

EP 0 654 637 A1 * 11/1993
GB 2 117 506 A * 10/1983

* cited by examiner

*Primary Examiner*—Josiah C. Cocks
(74) *Attorney, Agent, or Firm*—Townsend and Townsend and Crew LLP

(57) ABSTRACT

Embodiments of the present invention are directed to a low NOx duct burner or heater for efficiently heating turbine exhaust gases (TEG) in a less polluting manner. In one embodiment, a heater for heating a gaseous stream flowing in a downstream direction through a duct comprises a heating gas supply pipe extending at least partially across the duct. The heating gas supply pipe includes a plurality of spaced-apart gas pipe outlets to discharge a portion of a heating gas into the duct generally in the downstream direction. A flame shield extends from a location at or near the heating gas supply pipe at least partially across the duct. A plurality of gas supply spuds are disposed upstream of the flame shield. The gas supply spuds include a plurality of gas spud outlets to discharge another portion of the heating gas into the duct. A plurality of jet pumps each extend from a jet pump inlet at an upstream location upstream of the flame shield to a jet pump outlet at a downstream location downstream of the flame shield. Each jet pump inlet is disposed near one of the gas spud outlets to receive the heating gas from the gas spud outlet and the duct gas from the gaseous stream for premixing of the heating gas and the duct gas in the jet pump.

22 Claims, 2 Drawing Sheets

LOW NOX DUCT BURNER

CROSS-REFERENCES TO RELATED APPLICATIONS

This application claims benefit under 35 U.S.C. 119(e) to U.S. Provisional Application No. 60/422,624, filed Oct. 30, 2002.

BACKGROUND OF THE INVENTION

The present invention relates generally to heaters for raising the temperature of a gas flow and, more particularly, to a duct burner for efficiently heating turbine exhaust gases in a less polluting manner.

It is well known to use gas burners for raising the temperature of turbine exhaust gas (TEG) sufficiently (typically by between 100°–600° F.) so that the TEG can be used to generate steam, for example. Generating steam with TEG is efficient because the energy that would otherwise be needed for reaching the temperature of the incoming TEG is saved. In the past, a variety of TEG heaters have been proposed, such as those disclosed in U.S. Pat. Nos. 6,301,875, 4,767,319, 4,737,100, and 4,462,795, for example.

A recurring problem with known TEG heaters is that they release pollutants, particularly CO. Significant amounts of CO are a byproduct of known TEG heaters because there is insufficient time to convert initially formed CO from combusting the heating gas into $CO_2$ during the former's residence time in the flame or combustion zone of the heater. As part of the overall effort to protect the environment, regulations have therefore been promulgated in the United States which now limit the release of CO from TEG heaters to 0.1 lb/million btu generated by the heater. This is a stringent requirement in and of itself. It has become more difficult to attain with increased turbine efficiencies, which resulted in a decrease in $O_2$ concentration (by volume) in the TEG. To alleviate this, it has been proposed to augment the TEG heater with additional air. Although this helps to reduce CO emissions, since more $O_2$ is made available to effect a complete combustion of the heating gas, it lowers the efficiency of the heater because the augmenting air must be heated from ambient to the temperature of the incoming TEG.

Achieving complete combustion of the CO generated by the TEG heater becomes still more difficult when steam is injected into the turbine, which in turn reduces the $O_2$ concentration in the TEG.

It has previously been recognized that CO emissions are reduced by increasing the residence time for the CO in the combustion zone of the TEG heater because this enhances the likelihood that CO will find an available $O_2$ molecule and be converted to $CO_2$. Thus, for several years a TEG heater has been in use which consisted of a flame shield that extended across the TEG duct, had a gas supply pipe positioned on a center line of the duct, and had a flame shield defined by plates which diverged (in the downstream direction) from the gas pipe towards the walls of the duct. Spaced-apart slits were arranged in the plate through which TEG could flow into the combustion zone located downstream of the flame shield. Diverging heating gas jets were injected into the combustion zone to generate turbulence and effect a better mixing of heating gas with the TEG. Although this TEG heater worked well, it is unable to meet today's tightened CO emissions standards.

Other known TEG heaters have attempted a variety of different approaches to reduce CO emissions. These attempts principally concentrated on efforts to discharge the heating gas into the TEG flow to maximize turbulence and thereby a mixing of the TEG with the heating gas and/or augmenting the TEG with air to provide greater $O_2$ concentrations for oxidizing the heating gas. Still, the desired reduction in CO emissions to no more than 0.1 lb/$10^6$ btu in an energy efficient manner became difficult to attain.

BRIEF SUMMARY OF THE INVENTION

Embodiments of the present invention are directed to a low NOx duct burner or heater for efficiently heating turbine exhaust gases (TEG) in a less polluting manner. A plurality of jet pumps extend from an upstream side to a downstream side of the flame shield. A portion of the heating gas is injected into the jet pumps which also receive a portion of the TEG flow. The heating as and the TEG are premixed in the jet pumps. The premixed gas is discharged through the outlets of the jet pumps into the combustion region downstream of the flame shield. The premixed gas produces less pollution during combustion, and may further extend the combustion zone and increase the residence time for the CO to achieve additional conversion of CO into $CO_2$.

In accordance with an aspect of the present invention, a heater for heating a gaseous stream flowing in a downstream direction through a duct comprises a heating gas supply pipe extending at least partially across the duct. The heating gas supply pipe includes a plurality of spaced-apart gas pipe outlets to discharge a portion of a heating gas into the duct generally in the downstream direction. A flame shield extends from a location at or near the heating gas supply pipe at least partially across the duct. A plurality of gas supply spuds are disposed upstream of the flame shield. The gas supply spuds include a plurality of gas spud outlets to discharge another portion of the heating gas into the duct. A plurality of jet pumps each extend from a jet pump inlet at an upstream location upstream of the flame shield to a jet pump outlet at a downstream location downstream of the flame shield. Each jet pump inlet is disposed near one of the gas spud outlets to receive the heating gas from the gas spud outlet and the duct gas from the gaseous stream for premixing of the heating gas and the duct gas in the jet pump.

In some embodiments, the flame shield includes a plurality of jet pump openings, and each jet pump extends through one of the jet pump openings from the upstream location to the downstream location. The plurality of jet pumps are disposed on opposite sides of the heating gas supply pipe. The plurality of jet pumps are at least substantially symmetrically disposed on opposite sides of the heating gas supply pipe. The plurality of jet pumps may be oriented generally parallel in the downstream direction. Alternatively, he plurality of jet pumps may be oriented in a divergent manner with respect to the downstream direction and spaced by an angle of less than about 60 degrees. The jet pump inlets are flared. The jet pumps widen toward the jet pump outlets to form widened jet pump outlets. The jet pump outlets are disposed downstream with respect to the gas pipe outlets.

In specific embodiments, the gas spud outlets are configured to discharge about 50–90% and the gas pipe outlets are configured to discharge about 10–50% of a total amount of heating gas. The gas spud outlets are sized to produce a fuel pressure of up to about 20–50 psig at the gas spud outlets. The heating gas supply spuds and the jet pumps are configured to provide premixing of the heating gas and the duct gas in the jet pumps with a stoichiometric ratio of about 15–100%. The gas pipe outlets comprise orifices formed on the heating gas supply pipe. The flame shield comprises shield plates disposed on opposite sides of the heating gas supply pipe, the shield plates being obliquely inclined relative to the downstream direction through the duct. The flame shield comprises a plurality of duct gas openings to permit the duct gas of the gaseous stream therethrough. The heating gas supply spuds are coupled with the heating gas supply pipe to receive the heating gas from a common heating gas source.

In accordance with another aspect of the invention, a heater for heating a gaseous stream flowing in a downstream direction through a duct comprises a flame shield extending from an intermediate location of the duct partially toward opposite boundaries of the duct. A plurality of jet pumps each extend from a jet pump inlet at an upstream location upstream of the flame shield to a jet pump outlet at a downstream location downstream of the flame shield. The jet pump inlets receive a portion of the duct gas from the gaseous stream. The heater further comprises a mechanism for supplying a portion of the heating gas into the duct at a gas discharge location which is downstream of the flame shield and near the intermediate location of the duct, and another portion of the heating gas into the duct as gas jets directed into the jet pump inlets of the jet pumps for premixing of the heating gas and the duct gas in the jet pump.

In some embodiments, the mechanism supplies about 10–50% of the heating gas to the gas discharge location and about 50–90% of the heating gas to the jet pump inlets of the jet pumps. The jet pump inlets are disposed downstream of the gas discharge location.

DETAILED DESCRIPTION OF THE INVENTION

Figure 2:
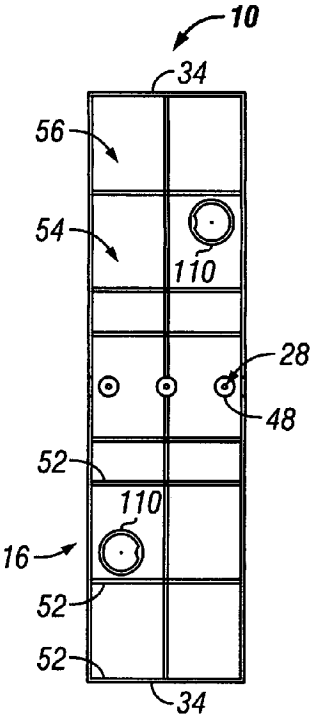
FIG. 2 is a partial, front elevational view of the duct heater shown in FIG. 1.
Figure 1:
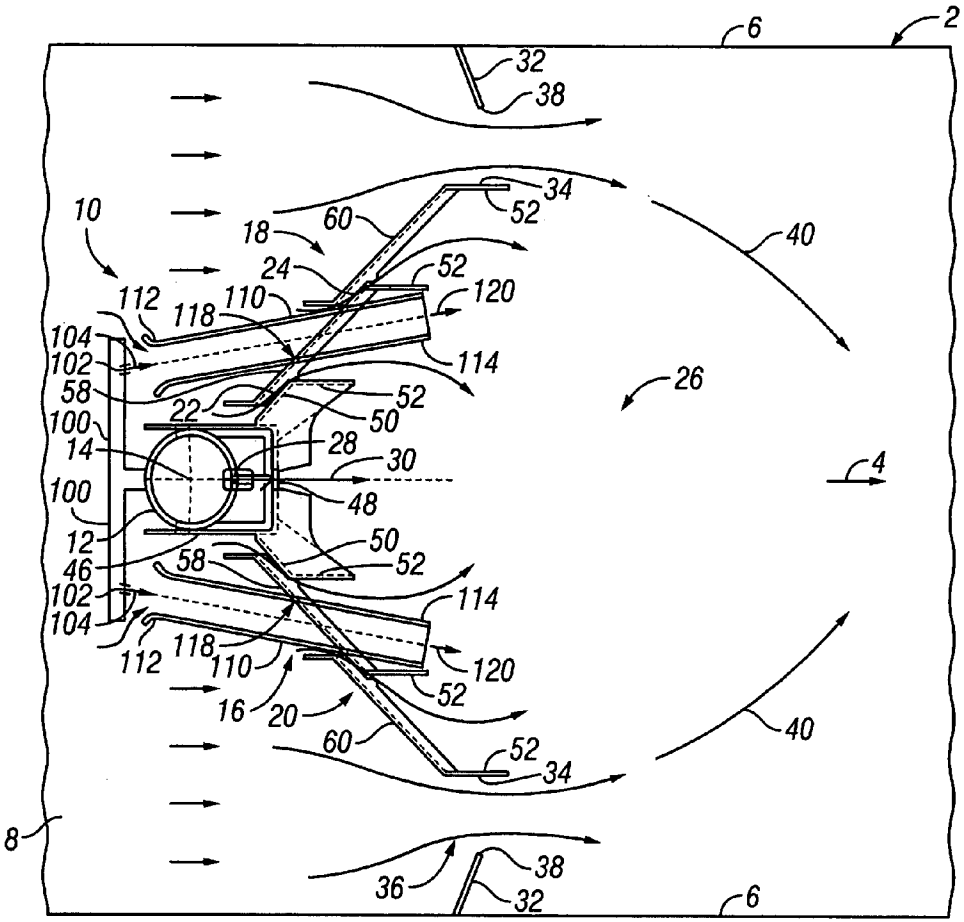
FIG. 1 is a simplified side elevational view of a turbine exhaust gas duct heater in accordance with an embodiment of the present invention.

As shown in FIGS. 1 and 2, a duct 2 through which a duct gas such as TEG flows in a downstream direction 4 is formed by two sets of opposing duct walls 6, 6 and 8, 8. FIG. 2 shows only one section of the heater 10; the remaining sections are arranged side-by-side horizontally across the duct 2. A duct heater 10 constructed in accordance with the invention has a normally horizontally disposed gas supply pipe 12 which extends across the width of the duct along its (horizontal) center line 14. The gas supply pipe 12 includes a plurality of spaced-apart gas pipe outlets 28. In this embodiment, the gas pipe outlets 28 are discharge orifices 28 which are arranged along the horizontal center line (plane) 14 of the pipe, face in the downstream direction 4, and discharge heating gas jets 30 parallel to the downstream direction into a combustion zone 26. In other embodiments, the gas pipe outlets 28 may be offset from the center plane 14 and oriented at an angle with respect to the downstream direction 4. Instead of orifices in the gas pipe 12, the gas pipe outlets 28 may include injects or nozzles coupled to the gas pipe 12.

A flame shield 16 is defined by shielding plates 18, 20 which diverge from the gas pipe in a downstream direction towards duct walls 6, 6. Each plate includes first and second duct gas openings or (horizontal) slits 22, 24 which permit a minor portion of the TEG to flow from an upstream side of the plates into a combustion zone 26 on the downstream side of the plates. In other embodiments, the slits 22, 24 may be eliminated, and the shielding plates 18, 20 may have other shapes and configurations.

A baffle 32 extends from each duct side wall 6 into the duct and towards an end edge 34 of the proximate shielding plate (18, 20) and has a free baffle edge 38 that is parallel to and aligned with edge 34. This defines a constriction 36 between free baffle edge 38 and the opposing edge 34 of the shielding plate (18, 20) which has a width (perpendicular to the flow direction) that is a multiple of the width of slits 22, 24 in the flame shield plates. In other embodiments, the baffle may be removed.

As shown in FIGS. 1 and 2, the flame shield 16 has a center piece the upstream end of which supports and is secured to gas pipe 12, for example, with welds. The downstream side of the center piece includes enlarged openings 48, which are aligned with the heating gas orifices 28 in the pipe, so that gas jets 30 can pass through the openings 48 into combustion zone 26. The center piece has extensions 50 which diverge in a downstream direction and end in TEG flow stabilizing flanges 52. First and second extension wings 54, 56 are attached to each extension 50 and its stabilizing flange 52, typically by welding, and are formed of elongated plate sections 58, 60. The plate sections are offset from each other in a downstream direction to form slits 22, 24 which are parallel to the plate sections and located between opposing, spaced-apart and overlapping surfaces of extension 50, plate section 58 and plate section 60, respectively. Each plate section also has a flow stabilizing flange 52. The outermost flange defines the earlier mentioned end edge 34 of flame shield 16. In alternative embodiments, the flame shield 16 may simply include a pair of plates extending from the gas pipe 12 without the numerous features shown and described above (see FIGS. 3 and 4).

A plurality of heating gas supply spuds 100 are disposed upstream of the flame shield 16. The spuds 100 are disposed on opposite sides of the gas supply pipe 12, and are desirably symmetrically arranged with respect to the pipe 12. While the gas pipe outlets 28 discharge a portion of the heating gas into the duct 2, the spuds 100 include a plurality of gas spud outlets 102 to discharge another portion of the heating gas into the duct 2 as gas jets 104. In specific embodiments, the gas spud outlets 102 are configured to discharge about 50–90% of the heating gas, while the gas pipe outlets 28 are configured to discharge about 10–50% of the heating gas. The percentages can be adjusted by varying the numbers and sizes of the gas spud outlets 102, and gas pipe outlets 28.

The gas spud outlets 102 are sized to produce a fuel pressure of up to about 20–50 psig at the gas spud outlets 102. At high fire, the fuel pressure is typically about 10–50 psig, and the fuel is discharged at a high velocity that may approach the sonic velocity. At low fire, the fuel pressure is typically about 0.25–1.0 psig.

A plurality of jet pumps 110 are provided to receive the gas jets 104 from the gas spud outlets 102. Each jet pump 110 extends from a jet pump inlet 112 at an upstream location upstream of the flame shield 16 to a jet pump outlet 114 at a downstream location downstream of the flame shield 16. The flame shield 16 includes a plurality of jet pump openings 118 through which the jet pumps 110 extend from the upstream location to the downstream location. The jet pumps 110 are disposed on opposite sides of the heating gas supply pipe 12. The jet pumps 110 may be eccentrically disposed in an offset manner with respect to the gas pipe 12 (as seen in FIG. 2), or they may be symmetrically disposed on opposite sides of the gas pipe 12 (see FIG. 4). In the embodiment shown, the jet pumps 110 are oriented in a divergent manner with respect to the downstream direction 4 and are desirably spaced by an angle of less than about 60 degrees. In other embodiments, the jet pumps 110 are oriented generally parallel in the downstream direction 4. The selection of the angle can be made to achieve the desired flame size and characteristics. The jet pumps 110 may be formed of straight, cylindrical pipes. Alternatively, the jet pump inlets 112 may be flared as seen in FIG. 1, and the jet pumps 110 widen toward the jet pump outlets to form widened jet pump outlets (see FIG. 3), the provide the desired jet pump flow characteristics.

Each jet pump inlet 112 is disposed near one of the gas spud outlets 102 to receive the heating gas jet 104 from the gas spud outlet 102 and the duct gas from the gaseous stream for premixing of the heating gas and the duct gas in the jet pump 110. The premixed gas is discharged through the jet pump outlets 114 as premixed gas jets 120. As shown in FIG. 1, the jet pump outlets 114 are disposed downstream with respect to the gas pipe outlets 28.

In use, heating gas jets 30 from orifices 28 are injected into combustion zone 26 generally in (i.e., parallel to) the downstream direction 4. TEG flows through the duct 2 and initially impacts on the upstream side of flame shield 16. From there, most of the TEG flows through constrictions 36 and, downstream thereof, forms two flows 40 which envelope combustion zone 26 and combine again at the downstream end thereof.

For the embodiment with slits 22, 24, relatively small portions of the incoming TEG flow through slits 22, 24 in shielding plates 18, 20, from which they emerge on the downstream side of the flame shield. TEG passing through the inner slit 22 forms an inner flow, while TEG passing through the outer slits 24 of the flame shield forms an outer flow which extends further downstream. These TEG flows recirculate to form one or more recirculation zones.

The heating gas jets 30 from the gas pipe 12 enter the recirculation zone(s) where they are combusted with $O_2$ obtained from the TEG flow through the slits 22, 24. The heating gas/TEG mixture then migrates towards the downstream recirculation zone. Where multiple recirculation zones are created by the TEG flow through the slits 22, 24, the combustion zone 26 is relatively long (and narrow), which increases the residence time for the CO so that more of it can be converted into $CO_2$ than is otherwise the case. By the time the now-combusted heating gas reaches the end of the combustion zone and reenters the main TEG flow, substantially all CO has been converted into $CO_2$ and $NO_x$ has been reburned as well. Thus, the now-heated TEG contains the above-mentioned low CO and $NO_x$ pollutant levels downstream of the combustion zone.

The premixed gas jets 120 from the jet pumps 110 produce a premixed gas flow that is combusted downstream of the combustion for the heating as jets 30 from the gas pipe 12. The premixed gas produces less pollution during combustion, and may further extend the combustion zone and increase the residence time for the CO to achieve additional conversion of CO into $CO_2$. In some preferred embodiments, the heating gas supply spuds 100 and the jet pumps 110 are configured to provide premixing of the heating gas and the duct gas in the jet pumps 110 with a stoichiometric ratio of about 15–100%. This is done by selecting the sizes and shapes of the gas spud outlets 102 and jet pumps 110.

Figure 4:
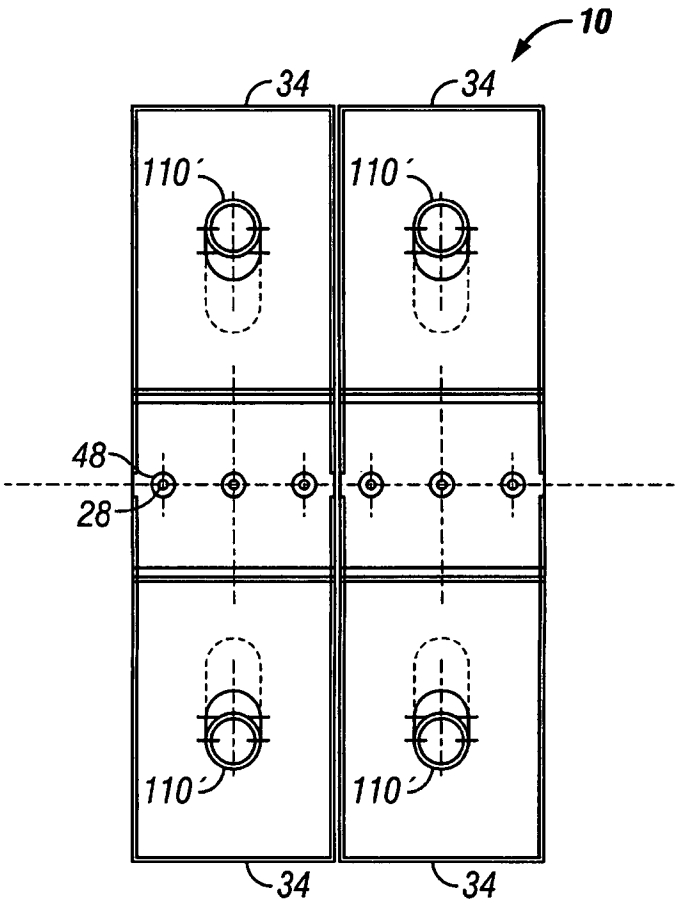
FIG. 4 is a partial, front elevational view of the duct heater shown in FIG. 3.
Figure 3:
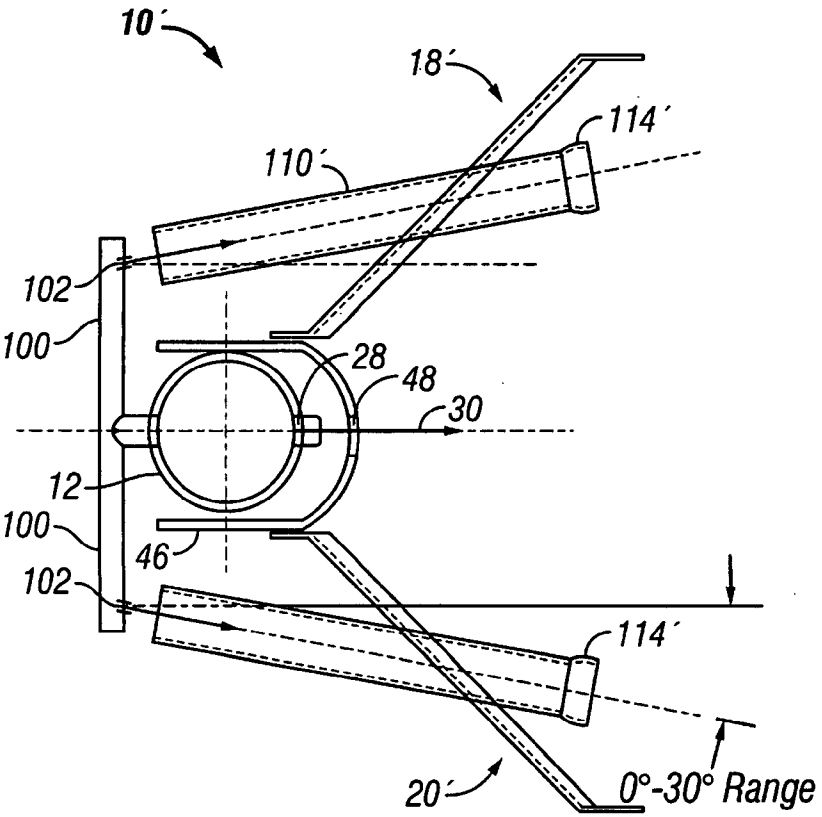
FIG. 3 is a simplified side elevational view of a turbine exhaust gas duct heater in accordance with another embodiment of the present invention.

FIGS. 3 and 4 show another embodiment of the heater 10' having single-piece shielding plates 18', 20' without slits. FIG. 4 shows two sections of the heater 10' arranged side-by-side. The jet pumps 110' have widened jet pump outlets 114'. The jet pumps 110' are symmetrically disposed on opposite sides of the gas pipe 12, as seen in FIG. 4.

Downstream of the combustion zone, the heated TEG is used for steam generation or to otherwise extract heat energy from it, as is well known to those skilled in the art. The heating gas may be natural gas or the like.

In a specific embodiment, the duct burner of the invention is fabricated from multiple, identical burner sections which are arranged side-by-side and abut each other, as is illustrated in FIG. 3. In this manner, duct burners for any desired duct width can be quickly and relatively inexpensively assembled.

The above-described arrangements of apparatus and methods are merely illustrative of applications of the principles of this invention and many other embodiments and modifications may be made without departing from the spirit and scope of the invention as defined in the claims. For instance, the flame shield 16 may have another configuration, and the gas pipe 12 may be formed differently to produce different gas jets 30. The scope of the invention should, therefore, be determined not with reference to the above description, but instead should be determined with reference to the appended claims along with their full scope of equivalents.

What is claimed is:

1. A heater for heating a gaseous stream flowing in a downstream direction through a duct, the heater comprising:

a heating gas supply pipe extending at least partially across the duct, the heating gas supply pipe including a plurality of spaced-apart gas pipe outlets to discharge a portion of a heating gas into the duct generally in the downstream direction;

a flame shield extending from a location at or near the heating gas supply pipe at least partially across the duct;

a plurality of gas supply spuds disposed upstream of the flame shield, the gas supply spuds including a plurality of gas spud outlets to discharge another portion of the heating gas into the duct;

a plurality of jet pumps each extending from a jet pump inlet at an upstream location upstream of the flame shield to a jet pump outlet at a downstream location downstream of the flame shield, each jet pump inlet being disposed near one of the gas spud outlets to receive the heating gas from the gas spud outlet and being spaced by a distance from the one of the gas spud outlets to receive the duct gas from the gaseous stream for premixing of the heating gas and the duct gas in the jet pump.

2. The heater of claim 1 wherein the flame shield includes a plurality of jet pump openings, and wherein each jet pump extends through one of the jet pump openings from the upstream location to the downstream location.

3. The heater of claim 1 wherein the plurality of jet pumps are disposed on opposite sides of the heating gas supply pipe.

4. The heater of claim 3 wherein the plurality of jet pumps are at least substantially symmetrically disposed on opposite sides of the heating gas supply pipe.

5. The heater of claim 3 wherein the plurality of jet pumps are oriented generally parallel in the downstream direction.

6. The heater of claim 3 wherein the plurality of jet pumps are oriented in a divergent manner with respect to the downstream direction and spaced by an angle of less than about 60 degrees.

7. The heater of claim 1 wherein the jet pump inlets are flared.

8. The heater of claim 1 wherein the jet pumps widen toward the jet pump outlets to form widened jet pump outlets.

9. The heater of claim 1 wherein the jet pump outlets are disposed downstream with respect to the gas pipe outlets.

10. The heater of claim 1 wherein the gas spud outlets are configured to discharge about 50–90% and the gas pipe outlets are configured to discharge about 10–50% of a total amount of heating gas.

11. The heater of claim 1 wherein the gas spud outlets are sized to produce a fuel pressure of up to about 20–50 psig at the gas spud outlets.

12. The heater of claim 1 wherein the heating gas supply spuds and the jet pumps are configured to provide premixing of the heating gas and the duct gas in the jet pumps with a stochiometric ratio of about 15–100%.

13. The heater of claim 1 wherein the gas pipe outlets comprise orifices formed on the heating gas supply pipe.

14. The heater of claim 1 wherein the flame shield comprises shield plates disposed on opposite sides of the heating gas supply pipe, the shield plates being obliquely inclined relative to the downstream direction through the duct.

15. The heater of claim 1 wherein the flame shield comprises a plurality of duct gas openings to permit the duct gas of the gaseous stream therethrough.

16. The heater of claim 1 wherein the heating gas supply spuds are coupled with the heating gas supply pipe to receive the heating gas from a common heating gas source.

17. A heater for heating a gaseous stream flowing in a downstream direction through a duct, the heater comprising:

a flame shield extending from an intermediate location of the duct partially toward opposite boundaries of the duct;

a plurality of jet pumps each extending from a jet pump inlet at an upstream location upstream of the flame shield to a jet pump outlet at a downstream location downstream of the flame shield, the jet pump inlets receiving a portion of the duct gas from the gaseous stream; and means for supplying a portion of the heating gas into the duct at a gas discharge location which is downstream of the flame shield and near the intermediate location of the duct, and another portion of the heating gas into the duct as gas jets directed into the jet pump inlets of the jet pumps for premixing of the heating gas and the duct gas in the jet pumps to be discharged through the jet pump outlets.

18. The heater of claim 17 wherein the means supplies about 10–50% of the heating gas to the gas discharge location and about 50–90% of the heating gas to the jet pump inlets of the jet pumps.

19. The heater of claim 17 wherein the jet pump inlets are disposed downstream of the gas discharge location.

20. The heater of claim 17 wherein the flame shield includes a plurality of jet pump openings, and wherein each jet pump extends through one of the jet pump openings from the upstream location to the downstream location.

21. A heater for heating a gaseous stream flowing in a downstream direction through a duct, the heater comprising:

a heating gas supply pipe extending at least partially across the duct, the heating gas supply pipe including a plurality of spaced-apart gas pipe outlets to discharge a portion of a heating gas into the duct generally in the downstream direction;

a flame shield extending from a location at or near the heating gas supply pipe at least partially across the duct;

a plurality of gas supply spuds disposed upstream of the flame shield, the gas supply spuds including a plurality of gas spud outlets to discharge another portion of the heating gas into the duct;

a plurality of jet pumps each extending from a jet pump inlet at an upstream location upstream of the flame shield to a jet pump outlet at a downstream location downstream of the flame shield, each jet pump inlet being disposed near one of the gas spud outlets to receive the heating gas from the gas spud outlet and the duct gas from the gaseous stream for premixing of the heating gas and the duct gas in the jet pump;

wherein the flame shield includes a plurality of jet pump openings, and wherein each jet pump extends through one of the jet pump openings from the upstream location to the downstream location.

22. A heater for heating a gaseous stream flowing in a downstream direction through a duct, the heater comprising:

a flame shield extending from an intermediate location of the duct partially toward opposite boundaries of the duct;

a plurality of jet pumps each extending from a jet pump inlet at an upstream location upstream of the flame shield to a jet pump outlet at a downstream location downstream of the flame shield, the jet pump inlets receiving a portion of the duct gas from the gaseous stream; and means for supplying a portion of the heating gas into the duct at a gas discharge location which is downstream of the flame shield and near the intermediate location of the duct, and another portion of the heating gas into the duct as gas jets directed into the jet pump inlets of the jet pumps for premixing of the heating gas and the duct gas in the jet pumps;

wherein the flame shield includes a plurality of jet pump openings, and wherein each jet pump extends through one of the jet pump openings from the upstream location to the downstream location.

* * * * *